US007205937B2

(12) United States Patent
Hein

(10) Patent No.: US 7,205,937 B2
(45) Date of Patent: Apr. 17, 2007

(54) NON-MULTIPLE DELAY ELEMENT VALUES FOR PHASE SHIFTING

(75) Inventor: Paul Walton Hein, McKinney, TX (US)

(73) Assignee: L-3 Integrated Systems Company, Greenville, TX (US)

( * ) Notice: Subject to any disclaimer, the term of this patent is extended or adjusted under 35 U.S.C. 154(b) by 154 days.

(21) Appl. No.: 10/835,274

(22) Filed: Apr. 29, 2004

(65) Prior Publication Data

US 2005/0242993 A1 Nov. 3, 2005

(51) Int. Cl.
*H01Q 3/22* (2006.01)

(52) U.S. Cl. ..... 342/372; 342/375

(58) Field of Classification Search ..... 342/375, 342/372

See application file for complete search history.

(56) References Cited

U.S. PATENT DOCUMENTS

| | | | | |
|---|---|---|---|---|
| 3,763,317 | A * | 10/1973 | Coleman et al. | 327/154 |
| 4,633,259 | A | 12/1986 | Hrycak | 342/373 |
| 4,638,317 | A | 1/1987 | Evans | 342/373 |
| 4,652,883 | A * | 3/1987 | Andricos | 342/372 |
| 5,583,517 | A | 12/1996 | Yokev et al. | 342/457 |
| 5,917,371 | A | 6/1999 | Chesarek et al. | 330/124 R |
| 6,088,337 | A | 7/2000 | Eastmond et al. | 370/280 |
| 6,320,481 | B1 * | 11/2001 | Sharma | 333/164 |
| 6,340,948 | B1 | 1/2002 | Munoz-Garcia et al. | 342/373 |
| 6,512,737 | B1 | 1/2003 | Agee | 370/208 |
| 2005/0270122 | A1 * | 12/2005 | Hyman et al. | 333/164 |

OTHER PUBLICATIONS

Luo et al., "Performance Analysis Of Compact Antenna Arrays With MRC In Correlated Nakagami Fading Channels," IEEE Trans. Veh. Tech. Paper submission, 99C241, Revised manuscript, (This reference obtained from the Internet Aug. 2003), 18 pgs.

Luo et al., "Error Probability Performance For Coherent DS-CDMA Systems In Correlated Nakagami Fading Channels," (This reference obtained for the Internet Aug. 2003), 5 pgs.

Jiang et al, "Comparison Of Random Phasing Methods For Reducing Beam Pointing Errors in Phased Array," IEEE Transactions On Antennas And Propagation, vol. 51, No. 4, Apr. 2003, pp. 782-787.

Kummer, "Basic Array Theory," Proceedings Of The IEEE, vol. 80, No. 1 Jan. 1992, pp. 127-140.

Godara, "The Effect Of Phase-Shifter Errors On The Performance Of An Antenna-Array Beamformer," IEEE Journal Of Oceanic Engineering, vol. OE-10, No. 3, July 1985, pp. 278-284.

(Continued)

*Primary Examiner*—Gregory C. Issing
(74) *Attorney, Agent, or Firm*—O'Keefe, Egan, Peterman, Enders LLP

(57) ABSTRACT

Non-multiple delay element values that may be implemented to reduce periodic quantization errors associated with phase shifting devices used in phased array apparatus. The non-multiple delay element values may be implemented so that a magnitude of phase shift imparted by a given delay element of a phase shifting scheme is not a multiple or a factor of the magnitude of the phase shift imparted by any other delay element employed in the same phase shifting scheme.

39 Claims, 4 Drawing Sheets

OTHER PUBLICATIONS

Salonen, "A 2.45GHz Digital Beam-Forming Antenna For RFID Reader," IEEE, 2002, pp. 1766-1770.

"Radar Handbook," Second Edition, McGraw-Hill Publishing Company, 1990, 6 pp.

J. Filter Web Site, http://www.jfilter.com/intro.html, "Introduction", printed from Internet Oct. 7, 2003, 1 pg.

J. Filter Web Site, http://www.jfilter.com/definition.html, "What Is It?", printed from Internet Oct. 7, 2003, 2 pgs.

J. Filter Web Site, http://www.jfilter.com/implementation.html, "What Is It Used For?", printed from Internet Oct. 7, 2003, 1 pg.

J. Filter Web Site, http://www.jfilter.com/technology.html, "How Does It Work", printed from Internet Oct. 7, 2003, 2 pgs.

J. Filter Web Site, http://www.jfilter.com/example.html, "Demonstration", printed from Internet Oct. 7, 2003, 1 pg.

J. Filter Web Site, http://www.jfilter.com/opportunity.html, "Opportunity", printed from Internet Oct. 7, 2003, 1 pg.

Search Report; PCT/US05/12687; 9 pgs.

* cited by examiner

NON-MULTIPLE DELAY ELEMENT VALUES FOR PHASE SHIFTING

This invention was made with United States Government support under Contract No. F33657-00-G-4029-0204. The Government has certain rights in this invention.

BACKGROUND OF THE INVENTION

1. Field of the Invention

This invention relates generally to phase shifting, and more particularly to phase array apparatus such as phased array antennas.

2. Description of the Related Art

Phased array apparatus are employed in a variety of applications for transmitting and receiving radar and other types of radio-frequency (RF) signals, and may be implemented in a variety of geometric array configurations. Examples of array configurations include linear arrays, two-dimensional arrays, planar arrays, rectangular arrays and conformal arrays. Phase shifting devices have been employed to alter the phases of signals transmitted or received by individual elements of a phased array apparatus in a binary weighted manner. By altering the phase of signals transmitted or received by individual phased array elements relative to each other the directional orientation of signals transmitted or received by the array may be controlled. Examples of phase shifting devices include digital phase shifting devices (e.g., diode phase shifter using switched-line, hybrid-coupled and loaded-line) and analog phase shifting devices that are digitally controlled (e.g., ferrite phase shifter).

In operation, phased array apparatus may suffer from periodic phase quantization or phase rounding errors which result in phase quantization sidelobes that degrade (raise) the side-lobe levels. Techniques that have been employed in the past to reduce phase quantization errors include the use of random phasing, the introduction of small errors into the feed network of an array, the addition of an extra phase bit, or the incorporation of a parabolic phase taper in the feed. In one particular example, random phasing has been implemented with ferrite or diode phase shifters in narrow band phased array antennas employed for radar applications.

SUMMARY OF THE INVENTION

Disclosed are methods and systems that may be implemented to reduce periodic quantization errors associated with phase shifting devices used in phased array apparatus. In the practice of the disclosed methods and systems, phase shifting may be implemented using one or more transmission line delay elements having non multiple delay element values (i.e., non-multiple phase shift values) to reduce or substantially eliminate periodic phase quantization errors. As used herein, the term "delay element value" refers to the magnitude of phase shift imparted by a given delay element of a phase shifting scheme. When used herein with reference to a plurality of delay elements of a given phase shifting scheme, the term "non-multiple delay element value" is used to describe a magnitude of phase shift imparted by a given delay element of the phase shifting scheme that is not a multiple or a factor of the magnitude of the phase shift imparted by any other delay element employed in the same phase shifting scheme. In other words, the relationship of the magnitude of the phase shift imparted by a given delay element is non-multiple relative to the magnitude of the phase shift imparted by any other delay element present in the same phase shifting scheme.

Examples of suitable non-multiple delay element values include, but are not limited to, a delay element value that is distributed relative to at least one other delay element value of a common phase shifting scheme in a manner that is based on a prime number-based factor. In one exemplary embodiment, a non-multiple delay element value may be further characterized as being distributed relative to at least one other delay element value of a common phase shifting scheme in a manner that is based on a non-integer factor. In another exemplary embodiment, a non-multiple delay element values may be further characterized as being distributed relative to at least one other delay element value of a common phase shifting scheme in a manner that is based on a non-binary factor.

When all delay element values of a phase shifting scheme have a non-multiple relationship with all other delay element values of the same phase shifting scheme, the delay element values of the phase shifting scheme may be further characterized as being distributed in a non-multiple manner. Similarly, when all delay element values of a phase shifting scheme have a non-integer relationship with all other delay element values of the same phase shifting scheme, the delay element values of the phase shifting scheme may be further characterized as being distributed in a non-integer manner. Similarly, when all delay element values of a phase shifting scheme have a non-binary relationship with all other delay element values of the same phase shifting scheme, the delay element values of the phase shifting scheme may be further characterized as being distributed in a non-binary manner.

Advantageously, the disclosed systems and methods may be implemented using non-multiple delay element values for phase shifting purposes in a manner that achieves better signal resolution, beam pointing accuracy, and lower side-lobe levels in a phased array apparatus as compared to conventional binary distributed phase shifting schemes using the same number or a greater number of delay elements. Thus, the disclosed systems and methods may be implemented in a manner that achieves lower signal loss with lower cost and a smaller device footprint as compared to conventional phase shifting techniques.

In one exemplary embodiment, a sufficient number of non-multiple delay element values (e.g., delay element values based on a set of prime number-based factors) may be selected for phase shift implementation in a phased array such that combinations of the selected non-multiple delay element values yields substantially no identical phases (modulo 360), or yields a reduced number of identical phases (modulo 360), relative to combinations of binary delay element values over a wide frequency bandwidth (e.g., 3.67:1 bandwidth) of operation, therefore substantially eliminating phase quantization errors over a full multi-octave frequency band-width of operation. Such a set of non-multiple delay element values may be further characterized as not having non-trivial common multiples.

By using non-multiple delay element values, the disclosed systems and methods may be advantageously implemented to reduce or substantially eliminate periodic phase quantization errors such as may be experienced when phase quantization is done in binary steps, i.e., with each delay element value being a multiple of the least significant bit (LSB). The reduction or substantial elimination of phase quantization errors advantageously allows coarser bit resolution or fewer phase shift delay elements to be employed in phased array apparatus implemented according to the disclosed systems and methods. The ability to use fewer phase shift delay elements allows the construction of lower cost, simpler and more compact (e.g., smaller footprint) phased array apparatus.

In one exemplary embodiment, the disclosed systems and methods may be implemented using transmission-line phase shifters, for example, when employed for broad-band (e.g., frequency bandwidths greater than or equal to about 2:1), wide scan angle phased array antennas. In another exemplary embodiment, the disclosed systems and methods may be advantageously implemented for use in broad band, multi-octave phased array antennas requiring low sidelobes. However, it will be understood that advantages of the disclosed systems and methods may also be realized when implemented with other types of phase shifting devices and/or phased array apparatus, such as those described elsewhere herein.

In another exemplary embodiment, the disclosed systems and methods may be advantageously implemented for with antenna apparatus configured for use in frequency bandwidths of greater than or equal to about 2:1, alternatively bandwidths of greater than or equal to about 3:1, alternatively bandwidths of greater than or equal to about 5:1, alternatively bandwidths of greater than or equal to about 10:1, alternatively bandwidths of greater than or equal to about 100:1, alternatively bandwidths of from about 2:1 to about 10:1, and alternatively bandwidths of from about 2:1 to about 100:1.

In one respect, disclosed herein is a phase shifting device configured to receive and change the phase of a signal. The phase shifting device may include at least two transmission line delay elements, the at least two transmission line delay elements including a first transmission line delay element and a second transmission line delay element configured to be coupled to the signal, such that the magnitude of a phase shift imparted to the signal by the first transmission line delay element is not a multiple or a factor of the magnitude of a phase shift imparted to the signal by the second transmission line delay element.

In another respect, disclosed herein is a phased array apparatus, including: a plurality of array elements; and a plurality of phase shifting devices, each of the plurality of phase shifting devices being coupled to a respective one of the plurality of array elements. Each of the plurality of phase shifting devices may be configured to vary the phase of a signal transmitted or received by each respective one of the array elements by a delay value that is non-multiple relative to the delay value of the other of the plurality of phase shifting devices.

In another respect, disclosed herein is a phased array antenna system, including: a plurality of antenna elements forming an antenna array; and a plurality of phase shifting devices, each of the plurality of phase shifting devices being coupled to at least a respective one of the plurality of antenna elements. Each of the plurality of phase shifting devices may include at least two transmission line delay elements configured to be selectably coupled together in series with a respective one of the plurality of array elements to independently vary the phase of a radio frequency signal transmitted or received by the respective one of the array elements. At least one of the transmission line delay elements of each of the phase shifting devices may have a delay element value that is non-multiple relative to a delay element value of at least one other of the transmission delay elements of the same phase shifting device.

In another respect, disclosed herein is a method of shifting the phase of a signal, including receiving a signal having a first phase in a phase shifting device that includes at least a first transmission line delay element and a second transmission line delay element. The method may also include shifting the phase of the received signal by a first phase shift magnitude relative to the first phase in the first transmission line delay element to form a signal having a second phase different than the first phase, and subsequently shifting the phase of the signal having a second phase by a second phase shift magnitude in the second transmission line delay element to form a signal having a third phase different than the first or second phases, and such that the first phase shift magnitude is not a multiple or a factor of the second phase shift magnitude.

In another respect, disclosed herein is a method of operating a phased array apparatus, including providing a plurality of array elements and providing a plurality of phase shifting devices, each of the plurality of phase shifting devices being coupled to a respective one of the plurality of array elements. The method may also include varying the phase of a signal transmitted or received by each respective one of the array elements by a delay value that is non-multiple relative to the delay value of the other of the plurality of phase shifting devices.

DESCRIPTION OF ILLUSTRATIVE EMBODIMENTS

Figure 1A:
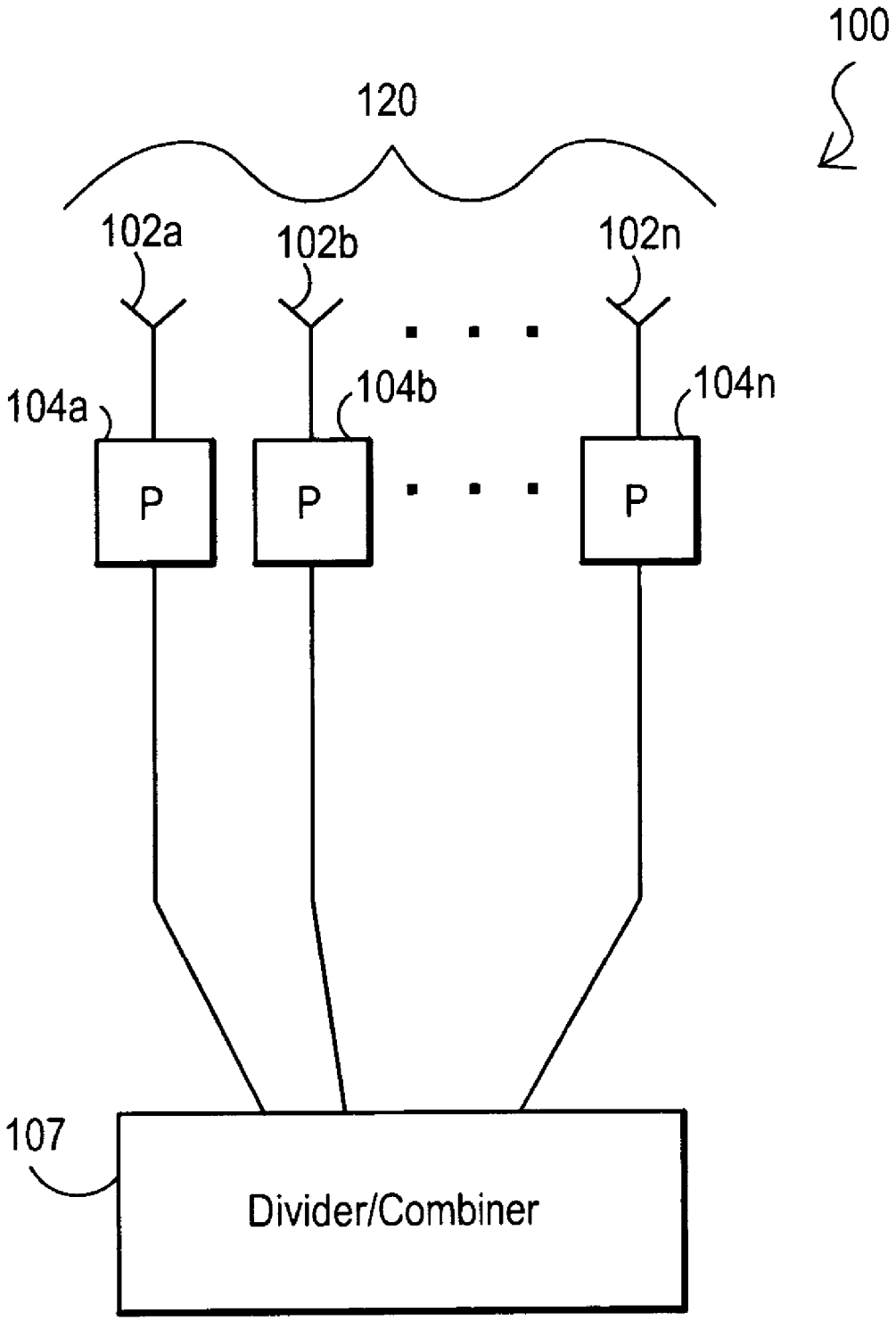
FIG. 1A is a block diagram of a phased array antenna system according to one embodiment of the disclosed systems and methods

FIG. 1A is a simplified block diagram of a phased array antenna system 100 according to one embodiment of the disclosed systems and methods. As illustrated in FIG. 1A, antenna system 100 includes an antenna array 120 made up of multiple antenna elements $\mathbf{102}_a$ through $\mathbf{102}_n$. As shown, each of multiple antenna elements $\mathbf{102}_a$ through $\mathbf{102}_n$ are coupled to a respective phase shifting device $\mathbf{104}_a$ through $\mathbf{104}_n$, each of which is in turn coupled to signal divider/combiner 107 that is configured to combine separate signals received by separate antenna elements antenna elements $\mathbf{102}_a$ through $\mathbf{102}_n$, and/or to divide separate signals to be transmitted by separate antenna elements $\mathbf{102}_a$ through $\mathbf{102}_n$, as appropriate. In the illustrated embodiment, each phase shifting device 104 may be digitally controlled to independently vary the phase of radiation or other type of signal transmitted or received by the respective element 102 coupled to the phase shifting device, e.g., relative to the phase of signals transmitted or received by other elements 102 of the array 120. As will be further explained, by so independently varying the phase signals are transmitted or received by each element 102 relative to each other element 102, the direction of maximum signal intensity transmitted or received by antenna array 120 may be controlled.

Figure 1B:
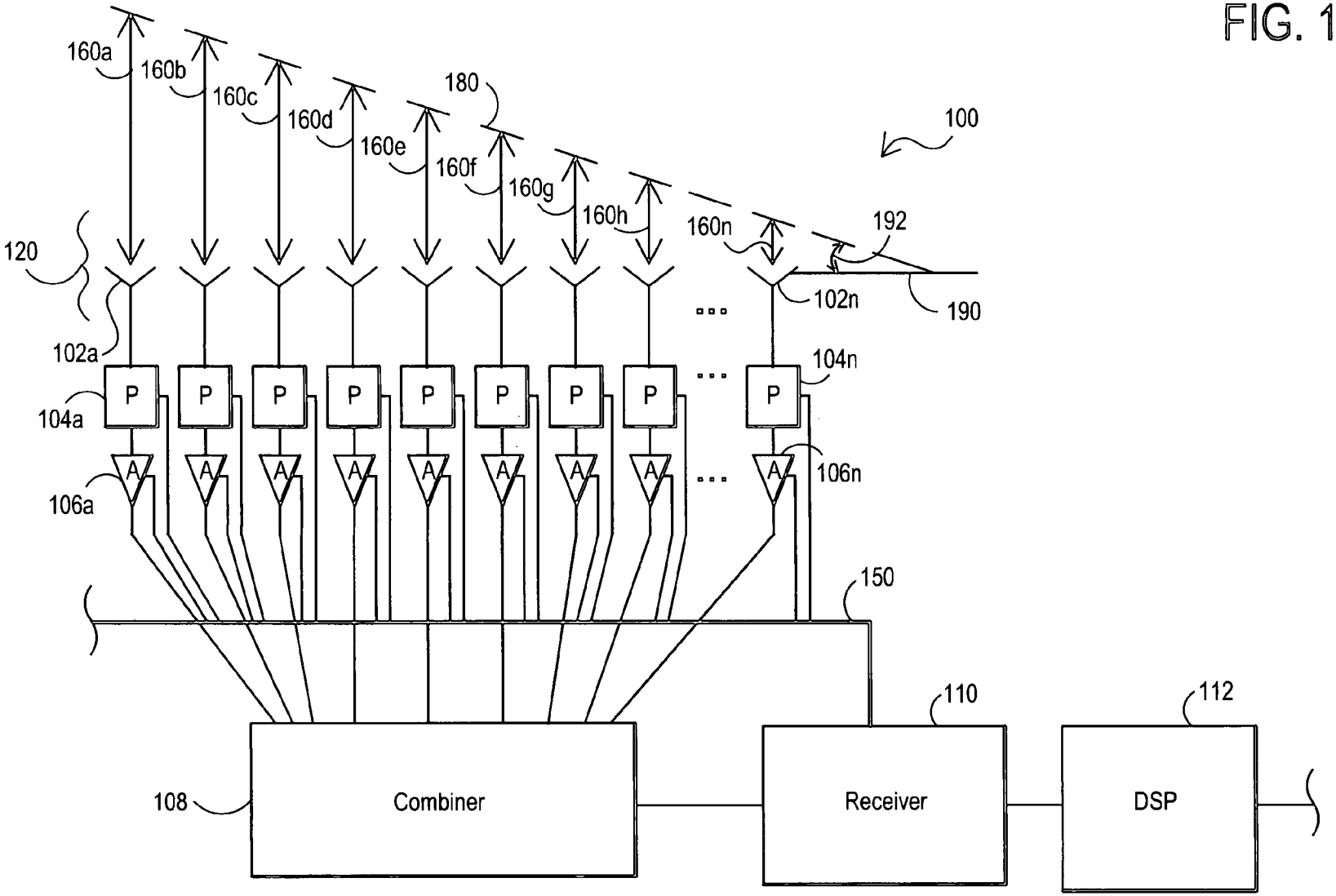
FIG. 1B is a block diagram of a phased array antenna system according to one embodiment of the disclosed systems and methods

FIG. 1B illustrates one exemplary embodiment of a phased array antenna system 100 having an antenna array 120 made up of multiple antenna elements 102 as it may be implemented to receive a directional signal wave front 180. Phase array antenna system 100 is illustrated configured as a receive-only system in FIG. 1B. However, it will be understood that in alternate embodiments a phase array antenna system 100 may be alternatively configured as a transmit only system (e.g., with divider circuitry coupled between a transmitter and phase shifting devices to divide separate signals to be transmitted by separate antenna elements $\mathbf{102}_a$ through $\mathbf{102}_n$), or may be alternatively configured as a transmit and receive system (e.g., with combiner/divider circuitry coupled between a transceiver and phase shifting devices to combine separate signals received by separate antenna elements antenna elements $\mathbf{102}_a$ through $\mathbf{102}_n$ and to divide separate signals to be transmitted by separate antenna elements $\mathbf{102}_a$ through $\mathbf{102}_n$). In this regard, it will be understood that the disclosed phase shifting methods and apparatus may be employed to vary the phase of transmitted signals in a manner similar to the process of varying the phase of received signals discussed in relation to the exemplary embodiment FIG. 1B.

As illustrated in FIG. 1B, each phase shifting device $\mathbf{104}_a$ through $\mathbf{104}_n$ is coupled to a respective amplifier $\mathbf{106}_a$ through $\mathbf{106}_n$, each of which is in turn coupled to combiner 108. Combiner 108 is shown coupled to receiver 110 and digital signal processor (DSP) 112. A control bus 150 is provided that provides control signals from receiver 110 to each of each phase shifting devices $\mathbf{104}_a$ through $\mathbf{104}_n$ and amplifiers $\mathbf{106}_a$ through $\mathbf{106}_n$. Using phase shifting device control signals provided by receiver 110, each phase shifting device 104 may be digitally controlled to independently vary the phase of radiation or other type of signal received by the respective element 102 relative to the phase of signals received by other elements 102 of the array 120. Using amplifier control signals provided by receiver 110, gain of each amplifier 106 may be optionally controlled relative to the gain of each other amplifier 106 to further control the pattern of signals received by antenna array 120.

FIG. 1B shows radiation or signal wave front 180 being received by antenna array 120 and having a longitudinal axis that is oriented at an angle with respect to the longitudinal axis 190 of antenna array 120. In the illustrated embodiment, the angle of orientation 192 of signal wave front 180 with antenna array 120 is controlled by individual signal delay times $\mathbf{160}_a$ through $\mathbf{160}_n$ that are imparted by respective phase shifting devices $\mathbf{104}_a$ through $\mathbf{104}_n$ in response to digital control signals provided by receiver 110. In this regard, the magnitude of individual signal delay times $\mathbf{160}_a$ through $\mathbf{160}_n$ may be cooperatively increased so as to increase magnitude of angle 192, or may be cooperatively decreased to decrease the magnitude of angle 192. When the magnitude of individual signal delay times $\mathbf{160}_a$ through $\mathbf{160}_n$ are set to be equal, the wave front angle 180 is 0° and energy wave front 180 is oriented parallel to the longitudinal axis 190 of antenna array 120.

It will be understood with benefit of this disclosure that FIGS. 1A and 1B illustrate only exemplary embodiments of phased array antenna systems as they may be implemented in the practice of the disclosed systems and methods. In this regard, the number and geometrical configuration of antenna elements, and/or the configuration and identity of processing circuit components coupled thereto, may be selected and varied as needed or desired to achieve the desired signal receiving and/or transmitting characteristics of a given antenna system application. For example, the specific configuration of elements, phase shifters, amplifiers, divider, combiner, transceiver and/or digital signal processor ("DSP") may be changed (e.g., position of amplifiers relative to phase shifting devices may be changed, control scheme for phase shifting devices and/or amplifiers changed, etc.), and/or the number and types of components changed (e.g., no DSP present; transceiver or transmitter substituted for receiver; combiner/divider or divider substituted for combiner; individual transceiver, receiver or transmitter directly coupled to each phase shifting device without presence of an intervening combiner/divider, combiner or transmitter; with no amplifiers coupled to phase shifting devices and using unamplified signals; etc.). Furthermore, an antenna array may be of any geometrical configuration suitable for implementation as a phased array including, for example, linear array, two and three-dimensional array, planar array, rectangular array, conformal array, etc.

In addition, although FIG. 1B shows control signals provided by receiver 110 through control bus 150, it will be understood that control for phase shifting devices 104 and/or amplifiers 106 may be provided in any suitable manner, e.g., by analog or digital control signals supplied by receiver 110, DSP 112, or by any other device capable of supplying suitable control signals. Furthermore, it will be understood that the disclosed systems and methods may be implemented without amplifiers 106 and/or without control provided over amplifiers 106. In addition, a group of multiple antenna elements 102 may be coupled to a single phase shifting device 104, and an antenna array 120 may be thus formed from individual groups of antenna elements 120 (i.e., rather than formed from single antenna elements 120). In such an implementation, the phase of signals transmitted or received by a given group of antenna elements may be independently varied by its respective phase shifting device relative to the phase of signals transmitted or received by other groups of antenna elements to achieve directional control over the received or transmitted signals.

Furthermore, it will be understood that the disclosed systems and methods may be implemented with any other type of phased array antenna system, with any other type of antenna system having multiple antenna elements, or with any other type of apparatus or system employed to phase shift a signal or to phase shift multiple signals relative to each other (e.g., apparatus or system having multiple phased array elements). In this regard, the disclosed systems and methods may be implemented with any apparatus configured to receive and/or transmit signals of any frequency or frequency range suitable for propagation through a variety of media including, but not limited to, gaseous medium (e.g., air), solid medium (e.g., earth, tissue), vacuum, etc. Examples of types of apparatus and systems that may be implemented with the disclosed systems and methods include, but are not limited to, phased array radio frequency (RF) antennas or beamformers, sonar arrays (for transmitting/receiving acoustic signals), ultrasonic arrays (ultrasonic signals for medical and flaw analysis imaging purposes), radar arrays (e.g., for bi-static and mono-static radar), mobile and land based telecommunications devices, seismic arrays, etc. Examples of specific types of phased array RF antennas that may be implemented with the disclosed systems and methods include, but are not limited to, narrow band phased array antennas, broad band phased array antennas, etc. In one embodiment, the disclosed systems and methods may be implemented at any RF frequencies where phased array antennas may be employed (e.g., HF band, KA band, M band, etc.) In another exemplary embodiment, the disclosed systems and methods may be employed in surveillance applications (e.g., airborne, ship-based, space-based, submarine based, etc.) including, but not limited to, as a part of a tactical reconnaissance system.

Figure 2:
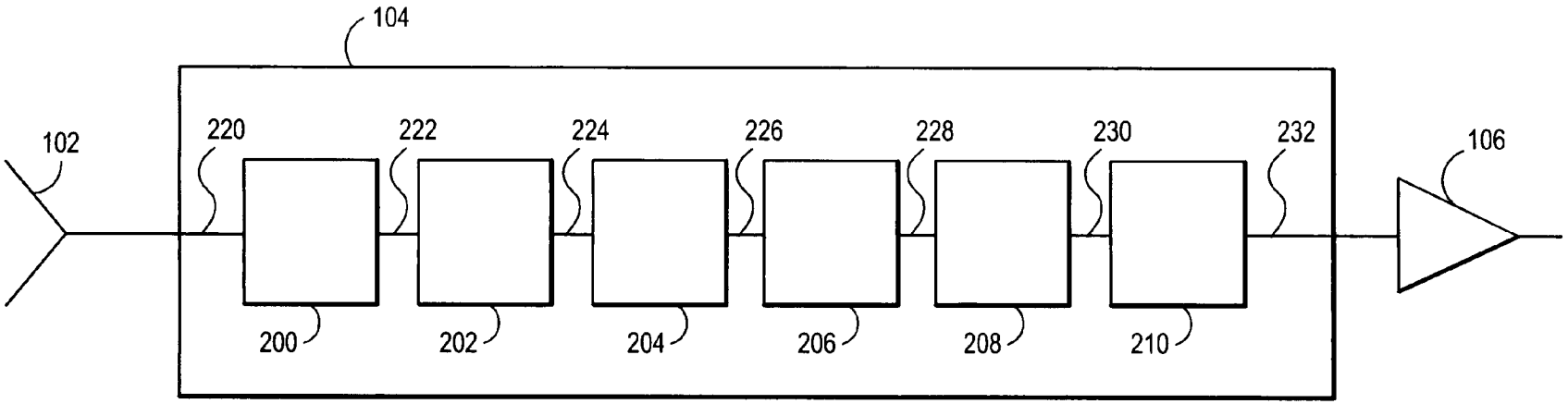
FIG. 2 is a block diagram showing a phase shifting device coupled between an antenna element and amplifier according to one embodiment of the disclosed systems and methods.

FIG. 2 illustrates one embodiment of an individual phase shifting device 104 of a phased array antenna system coupled between an antenna element 102 and amplifier 106. As shown, phase shifting device 104 has a six bit configuration that includes six transmission line phase quantization delay element devices 200, 202, 204, 206, 208 and 210 coupled together in series. Although phase shifting device 104 is illustrated as having six phase quantization delay element devices in FIG. 2, it will be understood that a phase shifting device may include any other suitable number of phase quantization delay element devices as desired or necessary to fit the requirements of a given application, e.g., greater or less than six devices. Furthermore, it will be understood that the disclosed systems and methods may be implemented using any other type of suitable phase shifting device or combinations of phase shift devices including digital phase shifting devices (e.g., diode phase shifter using switched-line, hybrid-coupled and loaded-line, etc.), and/or analog phase shifting devices that are digitally controlled (e.g., ferrite phase shifter, etc.).

Each transmission line phase quantization delay element device 200, 202, 204, 206, 208 and 210 may be of any configuration suitable for producing a phase shifted output signal by imparting a phase shift to a given input signal, i.e., in the configuration of FIG. 2 receiving a respective input signal 220, 222, 224, 226, 228 or 230 and producing a respective phase shifted output signal 222, 224, 226, 228, 230 or 232 based on the respective input signal.

In one exemplary embodiment, one or more of transmission line phase quantization delay element devices 200, 202, 204, 206, 208 and 210 may be selectably controlled to shift the phase of its respective input signal (i.e., 220, 222, 224, 226, 228 or 230), for example, in response to a respective control signal (not shown). For example, in one mode of operation, phase quantization delay element device 200 may be controlled to produce output signal 222 by shifting the phase of input signal 220 using a transmission delay line or other suitable delay feature, while at least one other phase quantization delay element device is controlled to produce an output signal by shifting the phase of its respective input signal by only a small amount relative to the phase shift imparted by phase quantization delay element device 200 (e.g., phase quantization delay element device 202 produces output signal 224 that is relatively close in phase to input signal 222). However, it will be understood that in other embodiments each of phase quantization delay element devices 200, 202, 204, 206, 208 and 210 may be non-controllable, i.e., in all modes of operation each phase quantization delay element device always produces an output signal by shifting the phase of its respective input signal by a fixed amount.

In the illustrated embodiment, phase shifting device 104 may be configured so that the delay element values of transmission line phase quantization delay element devices 200, 202, 204, 206, 208 and 210 are distributed in a non-multiple manner, i.e., each of phase quantization delay element devices 200, 202, 204, 206, 208 and 210 represents a non-multiple delay element value relative to the delay element values of the other phase quantization delay element devices of phase shifting device 104. This means that a delay element value for any given phase quantization delay element device of phase shifting device 104 is not a multiple or a factor of the delay element value of any other of the other phase quantization delay element devices of phase shifting device 104. In one exemplary embodiment, each of phase quantization delay element devices 200, 202, 204, 206, 208 and 210 may have a non-multiple delay element value that is a prime number, or that is based on a prime number (e.g., a prime number integer that is divided by 100). Such a non-multiple distributed phase shifting scheme may be advantageously implemented to substantially eliminate phase quantization errors when multiple phase shifting devices 104 having the same non-multiple distributed phase shifting scheme are coupled to respective antenna elements of a given antenna system.

However, it will be understood that in other embodiments, any one or more of phase quantization delay element devices 200, 202, 204, 206, 208 and 210 may be a non-multiple delay element value (e.g., based on a prime number factor) relative to the other phase quantization delay element devices, while other of the phase quantization delay element devices may be a multiple delay element value relative to at least one of the other phase quantization delay element values (e.g., binary bit values). In such an implementation, phase quantization errors may be reduced in comparison to multiple distributed phase shifting schemes, such as binary phase shifting schemes, where all of the phase quantization delay element devices have values that are multiples relative to each other. Further, it will be understood that in another exemplary embodiment an antenna system may be implemented with multiple phase shifting devices having different phase shifting schemes (e.g., a first phase shifting device may be configured with phase quantization delay element devices having different delay element values relative to the delay element values of phase quantization delay element devices of a second phase shifting device of the same antenna system) as long as the phase shift imparted by the first phase shifting device is not a multiple of factor of the phase shift imparted by the second phase shifting device. In such an exemplary embodiment, it is possible that the delay element values of first phase shifting device may distributed in a multiple or binary manner relative to each other (i.e., within the same phase shift device), while the overall phase shift value/s imparted by the first phase shift device is non-multiple relative to the overall phase shift value/s imparted by a second phase shifting device of the same system.

Figure 3:
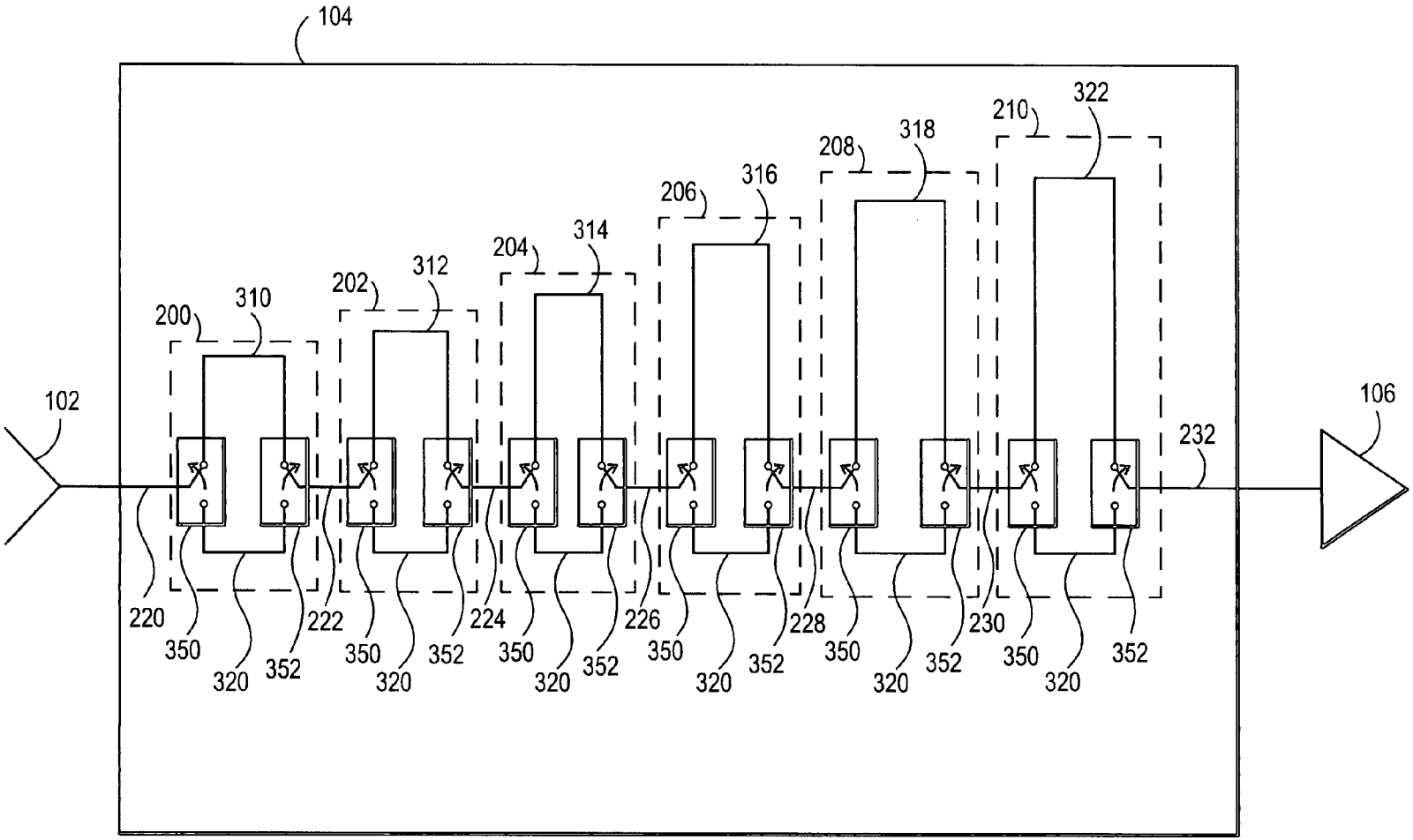
FIG. 3 is a block diagram showing a phase shifting device coupled between an antenna element and amplifier according to one embodiment of the disclosed systems and methods.

FIG. 3 illustrates one exemplary embodiment of an individual phase shifting device 104 of FIG. 2 in which each of six phase quantization delay element devices 200, 202, 204, 206, 208 and 210 are configured as transmission line phase quantization delay element devices that may be selectably coupled in series with element 102, amplifier 106 and with one or more of the other transmission line phase quantization delay element devices of phase shifting device 104. As shown, each of phase quantization delay element devices 200, 202, 204, 206, 208 and 210 includes a respective transmission delay line 310, 312, 314, 316, 318 or 322 of a length selected to provide the desired phase quantization bit delay. Each of phase quantization delay element devices 200, 202, 204, 206, 208 and 210 also includes a respective bypass line 320 coupled between a respective pair of switch modules 350 and 352.

For each phase quantization delay element device, the respective switch modules 350 and 352 of the phase quantization delay element device are configured to operate in a cooperative manner so that an input signal to the given phase quantization delay element device may be selectably coupled to either the transmission delay line of the given phase quantization delay element device (i.e., to produce an output signal having a phase shifted relative to the input signal) or to the bypass line 320 of the given phase quantization delay element device (i.e., to produce an output signal having substantially the same phase as the input signal). Thus, the phase shifting characteristics of phase shifting device 104 may be controlled by selectably coupling in series any desired combination of transmission delay lines (i.e., 310, 312, 314, 316, 318 and/or 322) and bypass lines 320 between the input signal 220 and output signal 232 of phase shifting device 104. In this manner, phase shifting device 104 may be selectably configured for maximum phase shift by coupling all six transmission delay lines 310, 312, 314, 316, 318 and 322 between the input signal 220 and output signal 232 of phase shifting device 104. Conversely, phase shifting device 104 may be selectably configured to provide a relatively small shift in phase by coupling all six bypass lines 350 of respective phase quantization delay element devices 200, 202, 204, 206, 208 and 210 between the input signal 220 and output signal 232 of phase shifting device 104.

Control for switch modules 350 and 352 of phase shifting device 104 may be provided in any suitable manner, e.g., by digital control signals (not shown) supplied by receiver 110, DSP 112, or by any other device capable of supplying suitable control signals. For example, control bit 100000 may be defined to control phase quantization delay element device 200, control bit 010000 may be defined to control phase quantization delay element device 202, etc. Although pairs of switch modules 350 and 352 are illustrated in the exemplary embodiment of FIG. 3, it will be understood that any other circuit configuration may be employed that is suitable for toggling or otherwise switching or selecting between a given transmission delay line and its respective bypass line.

Still referring to FIG. 3, the length of any one or more of respective transmission delay lines 310, 312, 314, 316, 318 and 322 may be selected to provide a phase quantization delay element that has a non-multiple delay element value (e.g., based on a prime number factor) relative to the other phase quantization delay element devices of phase shifting device 104. Further, the length of any one or more of respective transmission delay lines 310, 312, 314, 316, 318 and 322 may also be selected such that the difference in delay element value between any one or more of respective transmission delay lines 310, 312, 314, 316, 318 and 322 and their respective bypass lines 320 (i.e., of the same phase quantization delay element device) is non multiple relative to the difference in delay element value between one or more other respective transmission delay lines 310, 312, 314, 316, 318 and 322 and their respective bypass lines 320. In one exemplary embodiment, all respective transmission delay lines 310, 312, 314, 316, 318 and 322 may be selected to provide a phase quantization delay element that has a non-multiple delay element value relative to all other phase quantization delay element devices of phase shifting device 104 Further, in another exemplary embodiment, all respective transmission delay lines 310, 312, 314, 316, 318 and 322 may be selected such that the difference in delay element value between each respective transmission delay line 310, 312, 314, 316, 318 and 322 and its respective bypass line 320 (i.e., of the same phase quantization delay element device) is non multiple relative to the difference in delay element value between all other respective transmission delay lines 310, 312, 314, 316, 318 and 322 and their respective bypass lines 320. In this regard, it will be understood that length and delay characteristics of bypass lines 320 may be the same, or may vary, between different phase quantization delay element devices 200, 202, 204, 206, 208 and/or 210.

Although FIG. 3 illustrates an embodiment in which the lengths of transmission delay lines of phase quantization delay element devices 200, 202, 204, 206, 208 and 210 become progressively longer from the element side of phase shift device 104 to the amplifier side of phase shift device 104, it will be understood that the lengths of transmission delay lines may be configured in alternate ways. For example, the lengths of transmission delay lines of phase quantization delay element devices 200, 202, 204, 206, 208 and 210 may be randomly distributed or may become progressively shorter from the element side of phase shift device 104 to the amplifier side of phase shift device 104.

Table 1 is a comparison of delay element transmission line configuration details for a 6 bit phase shifting device employing binary distributed transmission line delay elements to one exemplary 600 MHz embodiment of 6 bit phase shifting device employing non-multiple distributed transmission line delay elements, such as may be employed with the phase shifting device illustrated and described with respect to FIG. 3.

TABLE 1

6 Delay element Transmission Delay Line Configuration

| Control Bit ID | Length of Binary Delay element (inches)* | Phase Shift of Binary Delay element (@ 600 MHz) | Binary Multiple Factor | Prime Number-Based Delay element Adjustment Factor | Length of Non-Multiple Delay element (inches) | Phase Shift of Non-Multiple Delay element (@ 600 MHz) |
|---|---|---|---|---|---|---|
| 100000 | 0.212 | 5.625 | 1 | 1.09 | 0.231 | 6.13125 |
| 010000 | 0.424 | 11.25 | 2 | 2.131 | 0.452 | 11.986875 |
| 001000 | 0.848 | 22.5 | 4 | 3.89 | 0.825 | 21.88125 |
| 000100 | 1.696 | 45 | 8 | 7.57 | 1.605 | 42.58125 |
| 000010 | 3.392 | 90 | 16 | 16.13 | 3.420 | 90.73125 |
| 000001 | 6.784 | 180 | 32 | 32.21 | 6.829 | 181.18125 |

*Length in transmission line (e.g., Teflon ™ or other similar material) having a relative dielectric constant of 2.1. In other embodiments, any other transmission line material may be employed that is suitable for achieving a delay value as needed or desired for a given application (e.g., ceramics, etc.)

As shown in columns two and three of Table 1, the least significant delay element (LBS) corresponding to control bit 100000 of the binary distributed phase shifting scheme has a length value of 0.212 inches and a phase shift value of 5.625. Each of the remaining five binary distributed delay elements corresponding to control bits 010000 through 000001 have length and phase shift values that are binary multiples of the respective length and phase shift values of the LSB (i.e., respective multiples of 2, 4, 8, 16 and 32). Such a binary distributed phase shifting scheme suffers from periodic phase quantization or phase rounding errors which result in phase quantization sidelobes, especially when operated over wide frequency bandwidth (e.g., bandwidths greater than about 2:1).

Column five of Table 1 lists prime number-based delay element adjustment factors that have been selected according to one exemplary embodiment so as to be relatively close to the binary multiple factors. In this embodiment, prime number-based delay element adjustment factors were selected to be relatively close in value to the binary multiple of the corresponding binary distributed phase shifting scheme. In each case, an integer prime number was selected and then divided by an appropriate base 10 exponential value to derive a prime number-based delay element adjustment factor having a value relatively close to the binary multiple of the corresponding binary distributed phase shifting scheme, i.e., 2.131 is based on the selected integer prime number 2131 divided by the value 1000 and corresponds to the binary multiple value of 2; 16.13 is based on the integer prime number 1613 divided by the value of 100 and corresponds to the binary multiple value of 16. It will be understood that the above-described methodology is exemplary only, and that any other methodology suitable for selecting or calculating prime number-based delay element adjustment factors that may be used to calculate or derive non-multiple delay element values may be employed including, but not limited to, independently selecting one or more prime number-based delay element adjustment factors without regard to binary multiple factors (e.g., empirical selection of prime numbers), etc.

Columns six and seven of Table 1 lists length values of and phase shift values for a non-multiple distributed phase shifting scheme that are based on the respective prime number delay element adjustment factors, i.e., each of the non-multiple distributed length values (column six of Table 1) corresponding to control bits 100000 through 000001 are products of the LSB binary delay element length value (0.212) and the respective prime number-based delay element adjustment factor (column five of Table 1) for control bits 100000 through 000001. In this regard, it will be understood that non-multiple distributed length values (e.g., such as given in column six of Table 1) may be rounded off as needed or desired to fit achievable or desired manufacturing tolerances for a given application, including to tolerances greater or lesser than that shown in Tables 1 and 2 herein.

Each of the non-multiple distributed phase shift values (column seven of Table 1) corresponding to control bits 100000 through 000001 are products of the LSB binary phase shift value (5.625) and the respective prime number-based delay element adjustment factor (column five of Table 1) for control bits 100000 through 000001. For example, the non-multiple distributed length value of 6.829 that corresponds to control bit 000001 is a rounded product of the LSB binary delay element length value of 0.212 and the prime number-based adjustment factor of 32.21 corresponding to control bit 000001. Similarly, the non-multiple distributed phase shift value of 42.58125 that corresponds to control bit 000100 is a product of the LSB binary delay element phase shift value of 5.625 and the prime number-based adjustment factor of 7.57 corresponding to control bit 000100.

In a manner similar to Table 1, Table 2 shows a comparison between delay element transmission line configuration details for a 5 bit phase shifting device employing binary distributed transmission line delay elements and one exemplary 600 MHz embodiment of 5 bit phase shifting device employing non-multiple distributed transmission line delay elements. In the embodiment of Table 2 a similar methodology was employed for selecting the non-multiple distributed delay element lengths and non-multiple distributed phase shift values as was employed for the embodiment of Table 1.

TABLE 2

5 Delay element Transmission Delay Line Configuration

| Control Bit ID | Length of Binary Delay element (inches)* | Phase Shift of Binary Delay element (@ 600 MHz) | Binary Multiple Factor | Prime Number-Based Delay element Adjustment Factor | Length of Non-Multiple Delay element (inches) | Phase Shift of Non-Multiple Delay element (@ 600 MHz) |
|---|---|---|---|---|---|---|
| 10000 | 0.424 | 11.25 | 1 | 1.09 | 0.462 | 12.2625 |
| 01000 | 0.848 | 22.5 | 2 | 2.131 | 0.904 | 23.97375 |
| 00100 | 1.696 | 45 | 4 | 3.89 | 1.649 | 43.7625 |
| 00010 | 3.392 | 90 | 8 | 7.57 | 3.210 | 85.1625 |
| 00001 | 6.784 | 180 | 16 | 16.13 | 6.839 | 181.4625 |

*Length in transmission line (e.g., Teflon ™ or other similar material) having a relative dielectric constant of 2.1.

Tables 1 and 2 represent one embodiment of the disclosed systems and methods in which a non-multiple distributed phase shifting scheme may be implemented using a set of non-multiple transmission line delay elements having length and phase shift values that have been calculated by multiplying a set of prime number-based delay element adjustment factors by a selected base (or LSB) value of transmission line length that has an associated base (or LSB) value of phase shift. In this regard, the selected base (or LSB) value of transmission line length is 0.212 for the six bit phase shift scheme of Table 1 and 0.424 for the 5 bit phase shift scheme of Table 2. The respective values of phase shift associated with the selected base (or LSB) values of transmission line length are 5.625 for the six bit phase shift scheme of Table 1, and 11.25 for the 5 bit phase shift scheme of Table 2.

For both phase shifting scheme embodiments of Table 1 and Table 2, the set of prime number-based delay element adjustment factors (1.09, 2.131, 3.89, 7.57, 16.13 and 32.21 for Table 1; 1.09, 2.131, 3.89, 7.57 and 16.13 for Table 2) have been selected so as to be relatively close to corresponding binary multiple factors of a binary distributed phase shifting scheme (1, 2, 4, 8, 16 and 32 for Table 1; 1, 2, 4, 8 and 16 for Table 2). Such an implementation may be desirable, for example, for purposes of ease of configuration and/or reduction in number of required delay elements for a given application, particularly in operating over wide, multi-octave frequency bandwidths (e.g., greater than about 2:1). In one exemplary embodiment of such an implementation, each prime number-based delay element adjustment factor may be selected to have a value that is within about 20% of the value of a corresponding binary multiple factor, alternatively each prime number-based delay element adjustment factor may be selected to have a value that is within about 15% of the value of a corresponding binary multiple factor, alternatively each prime number-based delay element adjustment factor may be selected to have a value that is within about 10% of the value of a corresponding binary multiple factor, and further alternatively each prime number-based delay element adjustment factor may be selected to have a value that is within about 5% of the value of a corresponding binary multiple factor. However, it will understood that prime number-based delay element adjustment factors may also be selected to have a value that is more than about 20% outside the value of a corresponding binary multiple factor.

Although exemplary embodiments employing non-multiple distributed phase shifting schemes based on prime number-based adjustment factors are illustrated with respect to Tables 1 and 2, it will be understood that other embodiments of the disclosed systems and methods may employ distributed phase shifting schemes having one or more non-multiple transmission line delay elements that are calculated or otherwise selected in any manner suitable for obtaining non-multiple transmission line delay element values as desired or needed to meet the needs of a given application, e.g., in any manner suitable for minimizing or substantially eliminating phase quantization errors as desired or needed. For example, prime number-based adjustment factors may be employed in the selection of one or more non-multiple transmission line delay elements of a given phase shifting scheme, while other of the transmission line delay elements of the phase shifting scheme may be non-multiple transmission line delay elements selected using a methodology other than using prime number-based adjustment factors, and/or may be transmission line delay elements that are binary or otherwise multiples of certain others of the transmission line delay elements in the given phase shifting scheme (e.g., a phase shifting scheme having a mixture of non-multiple delay elements and multiple delay elements). In other embodiments, one or more non-multiple transmission line delay elements may be selected using a methodology that does not rely on or involve prime numbers or prime number-based adjustment factors. Furthermore, it will be understood that particular delay element adjustment values and/or particular combinations of delay element adjustment values may be empirically evaluated (e.g., by simulation) to determine configurations that provide optimum performance (e.g., maximized reduction in phase quantization errors). In one exemplary embodiment, the total delay provided by non-multiple delay elements of a given phase shifting device may be selected to cover at least 360 degrees of delay when all the non-multiple delay elements of the phase shifting device are combined.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed systems and methods may be utilized in various combinations and/or independently. Thus the invention is not limited to only those combinations shown herein, but rather may include other combinations.

What is claimed is:

1. A phase shifting device configured to receive and change the phase of a signal, said phase shifting device comprising at least two transmission line delay elements, said at least two transmission line delay elements comprising a first transmission line delay element and a second transmission line delay element configured to be coupled to said signal; wherein the magnitude of a phase shift imparted to said signal by said first transmission line delay element is not a multiple or a factor of the magnitude of a phase shift imparted to said signal by said second transmission line delay element; wherein the magnitude of a phase shift imparted to said signal by said first transmission line delay element has a value that is based on a first prime number-based adjustment factor; and wherein the magnitude of a phase shift imparted to said signal by said second transmission line delay element has a value that is based on a second prime number-based adjustment factor; and wherein the magnitude of a phase shift imparted to said signal by said first transmission line delay element is equivalent to the product of a base phase shift value and said first prime number-based adjustment factor, and wherein the magnitude of a phase shift imparted to said signal by said second transmission line delay element is equivalent to the product of said base phase shift value and said second prime number-based adjustment factor.

2. The phase shifting device of claim 1, wherein said first and second transmission line delay elements are coupled together in series with said signal.

3. The phase shifting device of claim 1, wherein said first and second transmission line delay elements are configured to be selectably coupled together in series with said signal.

4. The phase shifting device of claim 1, wherein the magnitude of a phase shift imparted to said signal by said first transmission line delay element is not a multiple or a factor of the magnitude of a phase shift imparted to said signal by any other transmission line delay element of said phase shifting device.

5. The phased shifting device of claim 1, wherein said signal comprises a radio frequency signal, a radar signal, a sonar signal, a seismic signal or an ultrasonic signal.

6. The phase shifting device of claim 1, wherein said signal comprises a radio frequency signal.

7. A phased array apparatus, comprising:

a plurality of array elements; and a plurality of phase shifting devices, each of said plurality of phase shifting devices being coupled to a respective one of said plurality of array elements;

wherein each of said plurality of phase shifting devices is configured to vary the phase of a signal transmitted or received by each respective one of said array elements by a delay value that is non-multiple relative to the delay value of all other of said plurality of phase shifting devices;

wherein each of said plurality of phase shifting devices comprises at least two transmission line delay elements configured to be selectably coupled together in series with said respective one of said plurality of array elements to independently vary the phase of a signal transmitted or received by said respective one of said array elements; and wherein at least one of said transmission line delay elements has a delay element value that is non-multiple relative to a delay element value of at least one other of said transmission line delay elements;

wherein each of said transmission line delay elements has a delay element value that is non-multiple relative to all other of said transmission line delay elements;

wherein at least one of said transmission line delay elements has a delay element value that is equivalent to the product of a base phase shift value and a first prime number-based adjustment factor, and wherein a delay element value of at least one other of said transmission line delay elements is equivalent to the product of said base phase shift value and a second prime number-based adjustment factor.

8. The phased array apparatus of claim 7, wherein said phased array apparatus comprises a radio frequency antenna.

9. The phased array apparatus of claim 8, wherein said phased array apparatus is configured for transmitting or receiving signals having a frequency bandwidth of greater than or equal to about 2:1.

10. The phased array apparatus of claim 7, wherein said phased array apparatus comprises a radio frequency antenna array, a sonar array, a seismic array, an ultrasonic array, or a radar array.

11. The phased array antenna system of claim 7, wherein each of said transmission line delay elements has a delay element value that has a non-binary relationship with delay element values of all other of said transmission line delay elements of the same phase shifting device.

12. A phased array apparatus, comprising:

a plurality of array elements; and a plurality of phase shifting devices, each of said plurality of phase shifting devices being coupled to a respective one of said plurality of array elements;

wherein each of said plurality of phase shifting devices is configured to vary the phase of a signal transmitted or received by each respective one of said array elements by a delay value that is non-multiple relative to the delay value of all other of said plurality of phase shifting devices;

wherein each of said plurality of phase shifting devices comprises at least two transmission line delay elements configured to be selectably coupled together in series with said respective one of said plurality of array elements to independently vary the phase of a signal transmitted or received by said respective one of said array elements; and wherein at least one of said transmission line delay elements has a delay element value that is non-multiple relative to a delay element value of at least one other of said transmission line delay elements;

wherein each of said transmission line delay elements has a delay element value that is non-multiple relative to all other of said transmission line delay elements; and wherein at least one of said delay elements has a transmission line delay element value that is equivalent to the product of a base phase shift value and a first non integer factor, and wherein a delay element value of at least one other of said transmission line delay elements is equivalent to the product of said base phase shift value and a second non-integer factor.

13. A phased array antenna system, comprising:

a plurality of antenna elements forming an antenna array; and a plurality of phase shifting devices, each of said plurality of phase shifting devices being coupled to at least a respective one of said plurality of antenna elements;

wherein each of said plurality of phase shifting devices comprises at least two transmission line delay elements configured to be selectably coupled together in series with said respective one of said plurality of array elements to independently vary the phase of a radio frequency signal transmitted or received by said respective one of said array elements;

wherein each of said transmission line delay elements of each of said phase shifting devices has a delay element value that is non-multiple relative to a delay element value of all other of said transmission delay elements of the same phase shifting device; and wherein at least one of said transmission line delay elements has a delay element value that is equivalent to the product of a base phase shift value and a first prime number-based adjustment factor, and wherein a delay element value of at least one other of said transmission line delay elements is equivalent to the product of said base phase shift value and a second prime number-based adjustment factor.

14. The phased array antenna system of claim 13, wherein said phased array antenna system is configured for transmitting or receiving radio frequency signals having a frequency bandwidth of greater than or equal to about 2:1.

15. The phased array antenna system of claim 13, wherein said phased array system further comprises a signal divider, signal combiner, or a signal divider/combiner coupled to each of said phase shifting devices; and at least one of a receiver, transmitter, or a transceiver coupled to said signal divider, signal combiner, or a signal divider/combiner.

16. The phased array antenna system of claim 15, wherein said phased array antenna system further comprises an amplifier coupled between each of said phase shifting devices and said signal combiner, signal divider, or signal divider/combiner.

17. The phased array antenna system of claim 13, wherein each of said phase shifting devices is configured to independently vary the phase of a radio frequency signal transmitted or received by said respective antenna element coupled to said phase shifting device in response to a digital control signal received by said phase shifting device.

18. The phased array antenna system of claim 13, wherein each of said phase shifting devices is coupled to a respective group of said antenna elements to independently vary the phase of a radio frequency signal transmitted or received by said respective group of said antenna elements.

19. The phased array antenna system of claim 13, wherein said phased array antenna system is configured for airborne, ship-based, space-based, or submarine-based use.

20. The phased array antenna system of claim 13, wherein each of said transmission line delay elements has a delay element value that has a non-binary relationship with delay element values of all other of said transmission line delay elements of the same phase shifting device.

21. A phased array antenna system, comprising:

a plurality of antenna elements forming an antenna array; and a plurality of phase shifting devices, each of said plurality of phase shifting devices being coupled to at least a respective one of said plurality of antenna elements;

wherein each of said plurality of phase shifting devices comprises at least two transmission line delay elements configured to be selectably coupled together in series with said respective one of said plurality of array elements to independently vary the phase of a radio frequency signal transmitted or received by said respective one of said array elements;

wherein each of said transmission line delay elements of each of said phase shifting devices has a delay element value that is non-multiple relative to a delay element value of all other of said transmission delay elements of the same phase shifting device; and wherein at least one of said delay elements has a transmission line delay element value that is equivalent to the product of a base phase shift value and a first non integer factor, and wherein a delay element value of at least one other of said transmission line delay elements is equivalent to the product of said base phase shift value and a second non-integer factor.

22. A method of shifting the phase of a signal, comprising:

receiving a signal having a first phase in a phase shifting device comprising at least a first transmission line delay element and a second transmission line delay element;

shifting the phase of said received signal by a first phase shift magnitude relative to said first phase in said first transmission line delay element to form a signal having a second phase different than said first phase; and subsequently shifting the phase of said signal having a second phase by a second phase shift magnitude in said second transmission line delay element to form a signal having a third phase different than said first or second phases;

wherein said first phase shift magnitude is not a multiple or a factor of said second phase shift magnitude;

wherein said first phase shift magnitude has a value that is based on a first prime number-based adjustment factor, and wherein said second phase shift magnitude has a value that is based on a second prime number-based adjustment factor; and wherein said first phase shift magnitude is equivalent to the product of a base phase shift value and said first prime number-based adjustment factor, and wherein said second phase shift magnitude is equivalent to the product of said base phase shift value and said second prime number-based adjustment factor.

23. The method of claim 22, wherein said first and second transmission line delay elements are configured to be selectably coupled together in series with said signal.

24. The method of claim 22, wherein said method further comprises selecting said prime number-based adjustment factor to have a value that is within about 10% of the value of a binary multiple factor.

25. The method of claim 22, wherein said first phase shift magnitude and said second phase shift magnitude are not multiples or factors of the magnitude of a phase shift imparted by any other delay element of said phase shifting device.

26. The method of claim 25, wherein said phase shifting device comprises a part of a phased array apparatus that comprises a plurality of array elements and a plurality of phase shifting devices, each of said plurality of phase shifting devices being coupled to a respective one of said plurality of array elements.

27. The method of claim 26, wherein said signal comprises a radio frequency signal, a radar signal, a sonar signal, a seismic signal or an ultrasonic signal.

28. The method of claim 26, wherein said signal comprises a radio frequency signal.

29. The method of claim 28, wherein said signal comprises a radio frequency signal having a frequency bandwidth of greater than or equal to about 2:1.

30. A method of operating a phased array apparatus, comprising:

providing a plurality of array elements;

providing a plurality of phase shifting devices, each of said plurality of phase shifting devices being coupled to a respective one of said plurality of array elements; and varying the phase of a signal transmitted or received by each respective one of said array elements by a delay value that is non-multiple relative to the delay value of all other of said plurality of phase shifting devices;

wherein each of said plurality of phase shifting devices comprises at least two transmission line delay elements configured to be selectably coupled together in series with said respective one of said plurality of array elements to independently vary the phase of a signal transmitted or received by said respective one of said array elements; and wherein at least one of said transmission line delay elements has a delay element value that is non-multiple relative to a delay element value of at least one other of said transmission line delay elements; and wherein at least one of said transmission line delay elements of each of said plurality of phase shifting devices has a delay element value that is equivalent to the product of a base phase shift value and a first prime number-based adjustment factor, and wherein a delay element value of at least one other of said transmission line delay elements of the same phase shifting device is equivalent to the product of said base phase shift value and a second prime number-based adjustment factor.

31. The method of claim 30, wherein said signal comprises a radio frequency signal; and wherein said method further comprises operating said phased array antenna apparatus for airborne, ship-based, space-based, or submarine-based use.

32. The method of claim 31, wherein said signal comprises a radio frequency signal having a frequency bandwidth of greater than or equal to about 2:1.

33. The method of claim 30, wherein each of said transmission line delay elements has a delay element value that has a non-binary relationship with delay element values of all other of said transmission line delay elements of the same phase shifting device.

34. A method of operating an antenna array, comprising:

providing a plurality of phase shifting devices and a plurality of antenna elements forming said antenna array, each of said plurality of phase shifting devices being coupled to at least a respective one of said plurality of antenna elements, each of said plurality of phase shifting devices comprising at least two transmission line delay elements, and each of said transmission line delay elements of each of said phase shifting devices having a delay element value that is non-multiple relative to a delay element value of all other of said transmission delay elements of the same phase shifting device; and selectably coupling together at least two of said transmission line delay elements of each of said plurality of phase shifting devices in series with a respective one of said plurality of antenna elements that is coupled to said respective phase shifting device to independently vary the phase of a radio frequency signal transmitted or received by said respective antenna element;

wherein at least one of said transmission line delay elements of each of said plurality of phase shifting devices has a delay element value that is equivalent to the product of a base phase shift value and a first prime number-based adjustment factor, and wherein a delay element value of at least one other of said transmission line delay elements of the same phase shifting device is equivalent to the product of said base phase shift value and a second prime number-based adjustment factor.

35. The method of claim 34, wherein said radio frequency signal has a frequency bandwidth of greater than or equal to about 2:1.

36. The method of claim 34, further comprising selectably coupling together at least two of said transmission line delay elements of each of said plurality of phase shifting devices in series with a respective one of said plurality of antenna elements that is coupled to said respective phase shifting device in response to a digital control signal.

37. The method of claim 34, wherein each of said phase shifting devices is coupled to a respective group of said antenna elements; and wherein said method comprises selectably coupling together at least two of said transmission line delay elements of each of said plurality of phase shifting devices in series with a respective one of said groups of antenna elements that is coupled to said respective phase shifting device to independently vary the phase of a radio frequency signal transmitted or received by said respective group of said antenna elements.

38. The method of claim 34, further comprising operating said antenna array for airborne, ship-based, space-based, or submarine-based use.

39. A method of operating an antenna array, comprising:

providing a plurality of phase shifting devices and a plurality of antenna elements forming said antenna array, each of said plurality of phase shifting devices being coupled to at least a respective one of said plurality of antenna elements, each of said plurality of phase shifting devices comprising at least two transmission line delay elements, and each of said transmission line delay elements of each of said phase shifting devices having a delay element value that is non-multiple relative to a delay element value of all other of said transmission delay elements of the same phase shifting device; and selectably coupling together at least two of said transmission line delay elements of each of said plurality of phase shifting devices in series with a respective one of said plurality of antenna elements that is coupled to said respective phase shifting device to independently vary the phase of a radio frequency signal transmitted or received by said respective antenna element;

wherein at least one of said delay elements of each of said plurality of phase shifting devices has a transmission line delay element value that is equivalent to the product of a base phase shift value and a first non integer factor, and wherein a delay element value of at least one other of said transmission line delay elements of the same phase shifting device is equivalent to the product of said base phase shift value and a second non-integer factor.

* * * * *